US009314806B2

(12) United States Patent
Ballu et al.

(10) Patent No.: US 9,314,806 B2
(45) Date of Patent: Apr. 19, 2016

(54) ROTARY SPRAYER FOR SPRAYING A COATING MATERIAL, AND AN INSTALLATION INCLUDING SUCH A SPRAYER

(75) Inventors: Patrick Ballu, Reims (FR); Olivier Gourbat, Saint-Egreve (FR); Eric Prus, Grenoble (FR); Denis Vanzetto, Le Fontanil (FR)

(73) Assignee: SAMES TECHNOLOGIES, Meylan (FR)

( * ) Notice: Subject to any disclaimer, the term of this patent is extended or adjusted under 35 U.S.C. 154(b) by 1266 days.

(21) Appl. No.: 12/664,486

(22) PCT Filed: Jun. 12, 2008

(86) PCT No.: PCT/FR2008/000813

§ 371 (c)(1),
(2), (4) Date: Dec. 14, 2009

(87) PCT Pub. No.: WO2009/010646

PCT Pub. Date: Jan. 22, 2009

(65) Prior Publication Data

US 2010/0192848 A1 Aug. 5, 2010

(30) Foreign Application Priority Data

Jun. 13, 2007 (FR) ..... 07 04217

(51) Int. Cl.
*B05C 5/00* (2006.01)
*B05B 3/10* (2006.01)

(52) U.S. Cl.
CPC ..... *B05B 3/1092* (2013.01)

(58) Field of Classification Search
None
See application file for complete search history.

(56) References Cited

U.S. PATENT DOCUMENTS 5,141,156 A * 8/1992 Hoy et al. ..... 239/135
7,611,069 B2 * 11/2009 Clifford et al. ..... 239/7
2005/0040262 A1 2/2005 Nagai (Continued)

FOREIGN PATENT DOCUMENTS

DE 102005015604 A1 10/2006
EP 1685909 A1 8/2006

(Continued)

OTHER PUBLICATIONS

Takekimi et al, JP 08-099052, English translation.*

(Continued)

*Primary Examiner* — Charles Capozzi
(74) *Attorney, Agent, or Firm* — Browdy and Neimark, P.L.L.C.

(57) ABSTRACT

The invention relates to a rotary projector for a coating product that comprises a spraying member (1) having at least one ridge (12) capable of forming a jet of product, a means for rotating the member (1), a stationary body (2) having primary (4) and secondary (6) openings formed on primary and secondary outlines surrounding the rotation axis (X1) of the member (1) and for respectively outputting primary and secondary air jets (J6). Each primary air jet is inclined relative to the rotation axis (X1) in a primary direction such that the primary air jet freely crosses the area where the ridge (12) is located, while each secondary air jet is inclined relative to the rotation axis (X1) in a secondary direction (J6) having at least one axial component (A6) and one radial component (R6), said components (A6, R6) being such that the secondary air jet (J6) impinges on an outer surface (13) of the spraying member (1).

18 Claims, 5 Drawing Sheets

(56) References Cited

U.S. PATENT DOCUMENTS

| | | | | |
|---|---|---|---|---|
| 2007/0034715 | A1* | 2/2007 | Clifford et al. | 239/291 |
| 2007/0262170 | A1* | 11/2007 | Nolte et al. | 239/291 |
| 2009/0220703 | A1* | 9/2009 | Wohr | B05B 3/1014 427/475 |

FOREIGN PATENT DOCUMENTS

| | | | |
|---|---|---|---|
| JP | 01-249148 | A | 10/1989 |
| JP | 7-256156 | A | 10/1995 |
| JP | 871455 | A | 3/1996 |
| JP | 08-84941 | A | 4/1996 |
| JP | 08099052 | A | 4/1996 |
| JP | 08-196946 | A | 8/1996 |
| JP | 10-76190 | A | 3/1998 |
| JP | 2007-000826 | A | 1/2007 |
| WO | 2005115636 | A | 12/2005 |

OTHER PUBLICATIONS

Masatoshi et al (JPH1076190), English translation.*

* cited by examiner

ROTARY SPRAYER FOR SPRAYING A COATING MATERIAL, AND AN INSTALLATION INCLUDING SUCH A SPRAYER

The present invention relates to a rotary sprayer for spraying a coating material, and to an installation for spraying a coating material and including at least one such sprayer.

Conventional atomization by means of rotary sprayers is used for applying a primer, a base coat, and/or a varnish to articles that are to be coated, such as motor vehicle bodywork. A rotary sprayer for spraying a coating material includes an atomizer member rotating at high speed under drive from rotary drive means, such as a compressed air turbine.

Such an atomizer member is generally in the form of a bowl presenting symmetry of revolution and it includes at least one atomizer edge suitable for forming a jet of coating material. The rotary sprayer also has a stationary body housing the rotary drive means and also means for feeding the atomizer member with the coating material.

The jet of coating material atomized by the edge of the rotary member presents a shape that is generally conical and that depends on parameters such as the speed of rotation of the bowl and the flow rate of the coating material. In order to control the shape of this jet of material, prior art rotary sprayers are generally fitted with a plurality of primary orifices formed in the body of the sprayer and disposed on a circle centered on the axis of symmetry of the bowl. The primary orifices serve to deliver primary air jets that together form air for shaping the jet of material, which shaping air is sometimes referred to as "skirt" air.

JP-A-8 071 455 describes a rotary sprayer having primary orifices designed to deliver primary air jet for shaping the jet of material. Each primary air jet is inclined relative to the axis of rotation of the bowl in a primary direction presenting an axial component and a circumferential component. The primary air jets thus generate a turbulent air stream around the axis of rotation of the bowl and of the jet of coating material. This turbulent air stream, sometimes referred to as a "vortex", is used, in particular by adjusting its flow rate, to shape the jet of material atomized by the edge as a function of the intended application.

The body of the rotary sprayer shown in FIG. 6 of JP-A-8 071 455 is provided with a plurality of secondary orifices disposed on the same circle as the primary orifices and offset therefrom. Each secondary air jet from one of the secondary orifices is inclined relative to the axis of rotation in a secondary direction presenting an axial component and a radial component. These components are determined in such a manner as to inject air streams in front of the downstream face of the bowl, so as to reduce the suction caused by the bowl rotating at high speed.

Thus, the secondary air jets are intended to obtain a uniform film of deposited paint. For this purpose, it is necessary that the secondary air jets come directly into the suction zone situated facing the bowl and downstream therefrom. The direction of each secondary air jet is thus determined in such a manner as to avoid the secondary air jets striking the rear surface of the bowl.

Nevertheless, such secondary air streams require tricky adjustments in order to avoid damaging the shape of the jet of coating material. Furthermore, secondary air jets inclined in that way do not enable the shape of the jet of material to be adjusted and consequently do not enable the impact area of the atomized droplets on the article for coating to be adjusted.

The present invention seeks specifically to remedy those drawbacks by proposing a novel rotary device for spraying a coating material, which device provides great latitude in adjusting the shape of the jet of material.

To this end, the invention relates to a rotary sprayer for spraying a coating material, the sprayer comprising:

a material sprayer member presenting at least one sprayer edge suitable for forming a jet of material;

means for driving said member in rotation; and a stationary body presenting primary orifices disposed on a primary contour surrounding the axis of rotation of said member, and secondary orifices disposed on a secondary contour surrounding the axis of rotation of said member in a manner that is offset relative to the primary orifices, the primary and secondary orifices serving respectively to emit primary and secondary air jets, each primary air jet being inclined relative to the axis of rotation in a primary direction presenting at least an axial component and a circumferential component, such that said primary air jet freely crosses the region where the edge is located, each secondary air jet being inclined relative to the axis of rotation in a secondary direction presenting at least an axial component and a radial component. According to the invention, the components of each secondary air jet are such that said secondary air jet strikes an outside surface of the sprayer member.

By means of the invention, the secondary air jets burst against the atomizer member, thereby enabling the jet of atomized material to be adjusted finely and uniformly.

According to other characteristics of the invention that are advantageous, but optional, whether taken in isolation or in any technically feasible combination:

the body also presents tertiary orifices disposed on a tertiary outline surrounding the axis of rotation and designed to emit tertiary air jets, each tertiary air jet being inclined relative to the axis of rotation in a tertiary direction presenting axial, radial, and circumferential components such that said tertiary air jets freely cross the region where the edge is located;

at least one of the contours presents a shape that is regular and non-circular, e.g. elliptical or rectangular;

the orifices disposed on each contour are associated in subgroups of orifices that are juxtaposed from one to the next, each of the subgroups being connected to an independent compressed air feed source via a valve, the valves being controllable independently of one another;

the primary and secondary contours coincide with a circle centered on the axis of rotation;

the secondary direction presents a zero circumferential component;

the body presents primary and secondary channels opening out respectively via the primary and secondary orifices, the primary and secondary channels being inclined relative to the axis of rotation respectively along the primary and secondary directions;

the primary and secondary channels are made by drilling through an outer jacket and/or are constituted by gaps formed between the outer jacket and an inner jacket, the jackets being disposed around means for driving the member in rotation and a rear portion of the member;

the primary and secondary channels are connected respectively to a primary common chamber and to a secondary common chamber, said chambers being defined in the body and constituting two independent compressed air feed sources;

the primary orifices are arranged on the circle in alternation with the secondary orifices;

the components of the primary air jet are determined in such a manner that the primary air jets flow at a radial distance from the edge lying in the range 0 to 25 millimeters (mm), and that is preferably equal to 1.5 mm;

the components of the secondary air jets are determined in such a manner that the secondary air jets strike the member at an axial distance from the edge that lies in the range 0 to 10 mm, and that is preferably equal to 2.8 mm;

the circle on which the primary and secondary orifices are disposed has a diameter lying in the range 58 mm to 80 mm, and preferably equal to 68 mm, for a bowl having a diameter equal to 55 mm.

Furthermore, the invention also provides an installation for spraying a coating material, the installation being characterized in that it includes at least one rotary sprayer as specified above.

The invention can be better understood and other advantages thereof appear more clearly in the light of the following description of a rotary device and an installation in accordance with the invention, given purely by way of example and made with reference to the accompanying drawings, in which.

Figure 1:
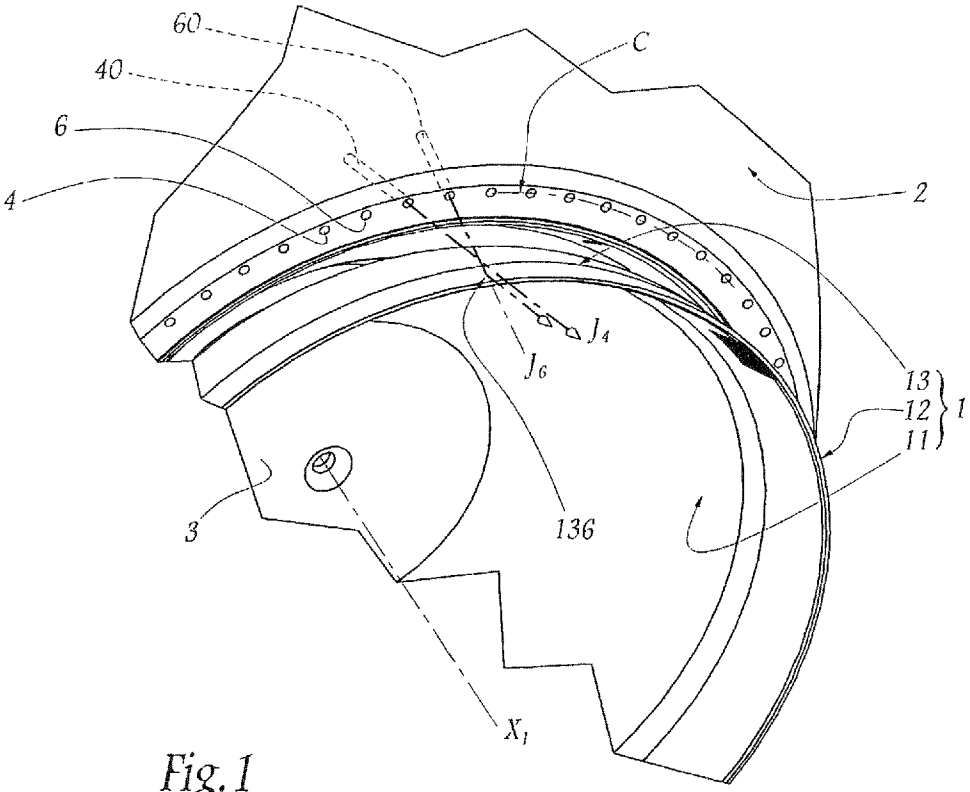
FIG. 1 is a truncated perspective view of a sprayer in accordance with the invention.

FIG. 1 shows a rotary sprayer for spraying a coating material, the sprayer comprising an atomizer member 1, referred to below as a "bowl", partially received within a body 2. The bowl 1 is shown in an atomizing position in which it is driven to rotate at high speed about an axis $X_1$ by drive means (not shown). The body 2 is stationary, i.e. it does not rotate about the axis of $X_1$, and it may be mounted on a support (not shown) such as a multiple axis robot arm.

A dispenser 3 is secured to the upstream portion of the bowl 1 to channel and spread the coating material. The speed of rotation of the bowl 1 in operation, i.e. when it is atomizing the material, may lie in the range 30,000 revolutions per minute (rpm) to 70,000 rpm.

The bowl 1 presents symmetry of revolution about the axis $X_1$. The bowl 1 has a spreader surface 11 on which the coating material spreads out under the effect of centrifugal force until it reaches an atomizer edge 12 where it is micronized into fine droplets. The set of droplets forms a jet $J_1$ of the material leaving the bowl 1 and travels towards an article to be coated, not shown, on which it produces an impact surface. The outside rear surface 13 of the bowl 1, i.e. its surface that does not face towards its axis of symmetry $X_1$, faces towards the body 2.

The body 2 has primary orifices 4 and secondary orifices 6 disposed on a common circle C centered on the axis of symmetry $X_1$ of the bowl 1. The primary and secondary orifices 4 and 6 are designed to emit respective jets of primary air and secondary air that are represented in the figures by their respective directions $J_4$ and $J_6$.

The edge 12 is at an axial distance $L_1$ from the circle C, which distance is equal to 10 mm in this example. The distance $L_1$ thus represents the extent to which the bowl 1 projects out from the body 2.

The primary and secondary directions $J_4$ and $J_6$ in this example are determined respectively by the angles of inclination of primary channels 40 and of secondary channels 60 defined in the body 2. In the example shown in the figures, the channels 40 and 60 are rectilinear and open out respectively via the primary and secondary orifices 4 and 6. Upstream, the channels 40 and 60 are connected to two independent sources, described below, for providing compressed air in order to form the jets $J_4$ and $J_6$.

Figure 2:
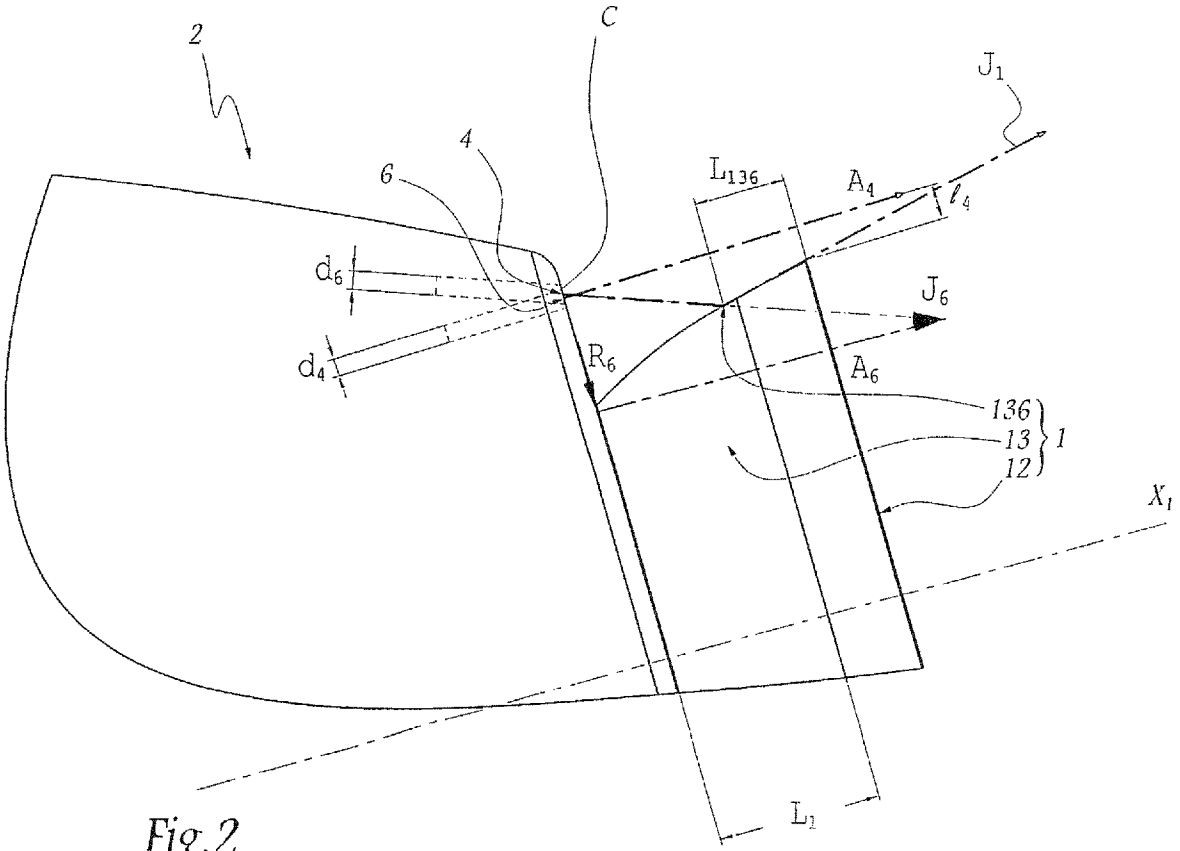
FIG. 2 is a fragmentary side view of the FIG. 1 sprayer.
Figure 3:
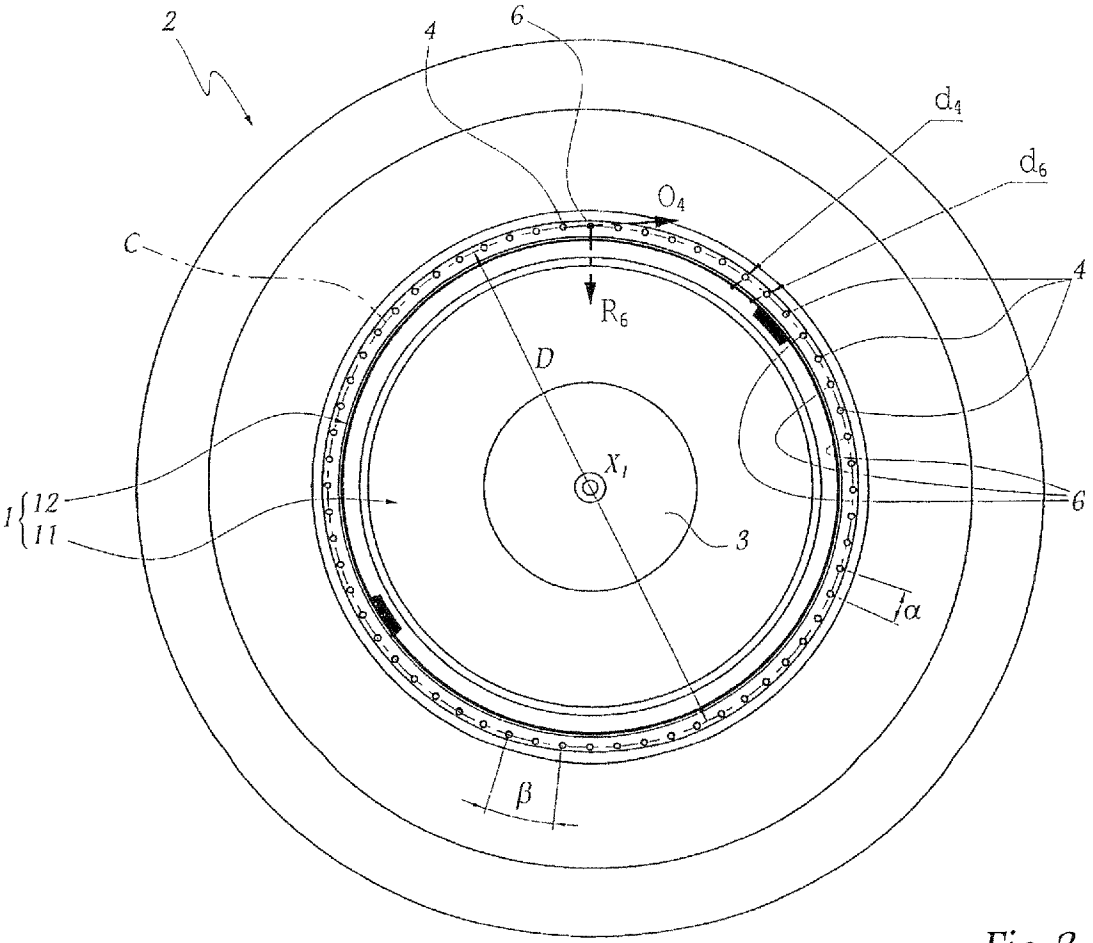
FIG. 3 is a face view of the FIG. 1 sprayer.

As shown in FIGS. 1 to 3, each primary air jet is inclined relative to the axis of rotation $X_1$ in a primary direction $J_4$ that presents an axial component $A_4$ and a circumferential component $O_4$. The components $A_4$ and $O_4$ are such that a primary air jet $J_4$ can freely cross the region where the edge 12 is located.

In other words, the primary jets $J_4$ do not strike the rear surface 13 of the bowl 1. A primary direction $J_4$ is thus oblique relative to the axis $X_1$, which it does not intersect. Together, the primary jets $J_4$ generate a turbulent air stream or vortex air suitable for influencing the shape of the jet of coating material. The components $A_4$ and $O_4$ of a primary air jet $J_4$ are determined in such a manner that the jet flows at a radial distance $l_4$ from the edge 12 that is equal to 1.5 mm. In practice, the distance $l_4$ may lie in the range 0 to 25 mm. The distance $l_4$ depends in particular on the axial distance $L_1$. Thus, when the distance $L_1$ is 50 mm, the distance $l_4$ may lie in the ratio 0 to 50 mm.

Each secondary air jet is inclined relative to the axis of rotation $X_4$ in a secondary direction $J_6$ that presents an axial component $A_6$ and a radial component $R_6$. In addition, the components $A_6$ and $R_6$ are determined in such a manner that a secondary air jet $J_6$ strikes the rear surface 13 of the bowl 1, as can be seen clearly in FIG. 2.

In other words, the secondary direction $J_6$ extends transversely relative to the axis of rotation $X_4$. Furthermore, the secondary direction $J_6$ in this example presents a circumferential component that is zero, thus enabling it to be considered as being a generator line of a cone having its vertex lying on the axis $X_1$.

The secondary air jet $J_6$ shown in FIG. 2 strikes the rear surface 13 in a zone 136, and then spreads over the portion of the surface 13 that is situated downstream from the zone 136 until it reaches the edge 12 and then continues beyond it in the axial direction $X_1$. This makes it possible to generate a secondary air stream in the form of a sheet that is relatively uniform and suitable for adjusting the shape of the jet of material, and thus for modifying the impact area on the article to be coated. The zone 136 is situated upstream from the edge 12 at an axial distance $L_{136}$ that is equal to 28 mm in this example. In practice, the distance $L_{136}$ may lie in the range 0 to 10 mm.

The diameter D of the circle C, which depends in particular on the diameter of the edge 12, is equal to 68 mm in this example for a bowl 1 having a diameter equal to 55 mm. In practice, it may lie in the range 58 mm to 80 mm for such a bowl.

On the circle C, the primary orifices 4 are arranged to alternate with the secondary orifices 6. As shown in FIG. 3, the primary and secondary orifices 4 and 6 are distributed uniformly around the circle C, such that two successive primary orifices 4 or two successive secondary orifices 6 are spaced apart by the same angle $\beta$ that is equal to 12°. In practice, this angle $\beta$ may lie in the range 6° to 24°. In addition, a primary orifice 4 and a secondary orifice 6 that are adjacent are spaced apart by an angle $\alpha$ equal to 6°, i.e. half the angle $\beta$ between two successive primary orifices 4, for example. In practice, the angular offset $\alpha$ between a primary orifice 4 and a secondary orifice 6 may lie in the range 3° to 12°.

The number and the distribution of primary and secondary orifices 4 and 6 is determined as a function of the accuracy desired for controlling the shape of the jet of material and as a function of the uniformity that is desired for the impact area.

Thus, the greater the number of orifices 4 and 6, the greater the extent to which the impact area is uniform. In a variant, provision can be made for the numbers of primary and secondary orifices to be different.

The primary and secondary orifices 4 and 6 have respective diameters $d_4$ and $d_6$ that are equal to 0.8 mm and 0.8 mm. Such dimensions enable primary and secondary air jets to be delivered at flow rates that are respectively equal to 700 liters per minute (L/min) and to 500 L/min, when they are fed with respective pressures of 6 bars and 6 bars. In practice, the diameters $d_4$ and $d_6$ of the primary and secondary orifices 4 and 6 may lie respectively in the ranges 0.5 mm to 1.5 mm and 0.5 mm to 1.5 mm. In particular, the diameters $d_4$ and $d_6$ may be different from each other.

Figure 4:
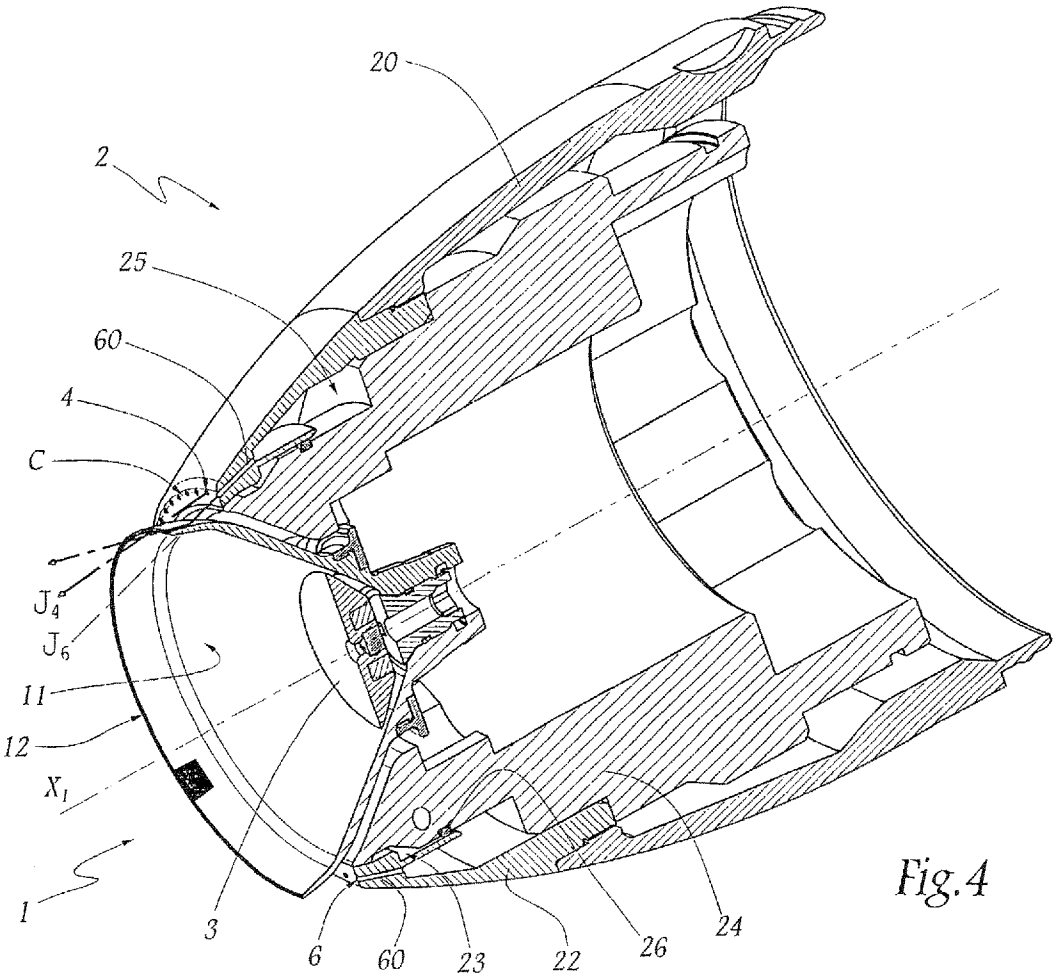
FIG. 4 is a cutaway perspective view on a smaller scale of the FIG. 1 sprayer.

As shown in FIG. 4, the primary channels 40 and the secondary channels 60 extend in rectilinear manner through an outer jacket 22 that extends a cap 20 defining an outer casing for the body 2. The channels 40 and 60 are made by appropriate drilling operations at suitable angles. The primary channels 40 are connected upstream to a primary chamber 23 that is common to all of them and that is itself connected to a compressed air source, not shown. Similarly, the second channels 60 are connected to a secondary chamber 25 that is common to all of them and that is connected to a compressed air source, not shown, that is independent from the source feeding the primary channels 40.

In this example, the primary and secondary chambers 23 and 25 are formed between the outer jacket 22 and an inner jacket 24, and they are separated by a sealing O-ring 26. The adjective "internal" is used herein to designate an article that is close to the axis of rotation $X_1$, while the adjective "outer" is used to designate an article that is further away therefrom. The jackets 22 and 24 present globally a symmetry of revolution around the axis $X_1$.

Alternatively, the primary and/or secondary channels 40 and 60 may be defined by gaps formed between the outer and inner jackets 22 and 24. Under such circumstances, these gaps may be made by machining notches in one and/or the other of the facing surfaces of the inner and outer jackets 24 and 22.

Figure 5:
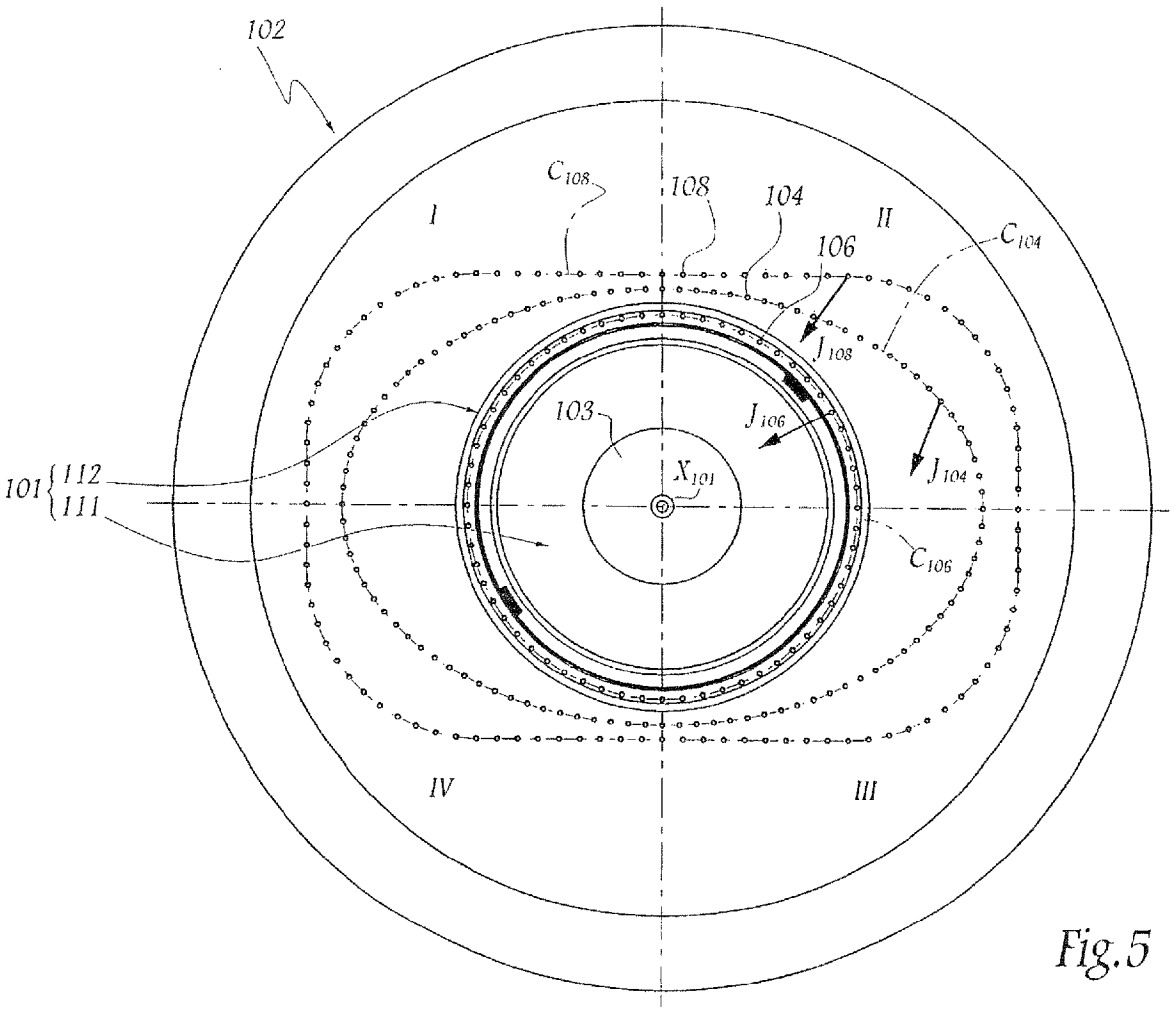
FIG. 5 is a face view of a sprayer in accordance with another embodiment of the invention.

FIG. 5 shows a variant of the rotary sprayer of FIGS. 1 to 4 in which numerical references having 100 added thereto are used to designate articles that are similar to those shown in FIGS. 1 to 4.

This rotary sprayer for spraying a coating material comprises a bowl 101 analogous to the bowl 1 that is partially received within a stationary body 102. The bowl 101 may be driven in rotation at high speed about an axis $X_{101}$ and it is fed with material via a dispenser 103.

The bowl 101 has a spreader surface 111 over which the coating material spreads out until it reaches an atomizer edge 112 where it is micronized into fine droplets.

The body 102 presents primary, secondary, and tertiary orifices 104, 106, and 108 that are disposed respectively on primary, secondary, and tertiary contours $C_{104}$, $C_{106}$, and $C_{108}$. The contours $C_{104}$, $C_{106}$, and $C_{108}$ are plane and respectively elliptical, circular, and rectangular. The orifices 104, 106, and 108 are for delivering respective primary, secondary, and tertiary air jets that are represented in FIG. 5 by their respective directions $J_{104}$, $J_{106}$, and $J_{108}$.

The primary and tertiary contours $C_{104}$ and $C_{108}$ are centered on the axis of rotation $X_{101}$ and they present shapes that are elongate along the same main direction, being respectively elliptical and rectangular with rounded corners. Thus, the primary and tertiary air jets $J_{104}$ and $J_{108}$ serve to shape the jet of sprayed material by flattening it. This serves to optimize the overlap of impacts on the article to be coated, and consequently to optimize the uniformity of the thickness that is deposited.

Furthermore, for each contour $C_{104}$, $C_{106}$, or $C_{108}$, the orifices 104, 106, or 108 are associated in four subgroups of orifices so as to form four quadrants I, II, III, and IV. The orifices in a given subgroup defined by a quadrant are juxtaposed from one to the next, i.e. they form an uninterrupted sequence.

Each subgroup is connected to an independent compressed air feed source via a valve, not shown. The four valves of the four subgroups of a given contour are independent from one another, thus making it possible to modulate the shapes of the primary, secondary, and tertiary air jets. For this purpose, it is possible to feed the orifices of some of the quadrants with compressed air while not feeding the orifices of the remaining quadrants.

Where necessary, the subdivision into subgroups could be implemented other than by quadrant.

Furthermore, in the embodiments of FIGS. 1 to 4 and 5, the directions $J_6$ or $J_{106}$ of the secondary air jet may be inclined to a greater or lesser extent relative to the radial direction so as to strike the bowl at a distance $L_{136}$ from the edge that varies from one orifice to another.

The characteristics of the embodiments described above may be combined. For example, the air jets of the sprayer of FIGS. 1 to 4 may be controlled by quadrant.

The invention claimed is:

1. A rotary sprayer for spraying a coating material, the sprayer comprising:

a material sprayer member having an axis of rotation and presenting at least one sprayer edge suitable for forming a jet of material;

a rotary drive member connected to drive said material sprayer member in rotation; and a stationary body presenting primary orifices disposed on a primary contour surrounding the axis of rotation of said material sprayer member, and secondary orifices disposed on a secondary contour surrounding the axis of rotation of said material sprayer member in a manner that the secondary orifices are circumferentially offset relative to the primary orifices, the primary and secondary orifices serving respectively to emit primary and secondary air jets, each primary air jet being emitted in a respective primary direction that is inclined relative to the axis of rotation, the primary direction presenting at least an axial component and a circumferential component, such that said primary air jet freely crosses the region where the at least one sprayer edge is located, each secondary air jet being emitted in a respective secondary direction that is inclined relative to the axis of rotation, the secondary direction presenting at least an axial component and a radial component, wherein the components of each said secondary air jet are such that each said secondary air jet strikes an outside surface of the sprayer member, and wherein the primary and secondary contours coincide with a common circle centered on the axis of rotation, and wherein the body presents primary channels and secondary channels opening out respectively via the primary and secondary orifices, the primary and secondary channels being inclined relative to the axis of rotation respectively along the primary and secondary directions.

2. A rotary sprayer according to claim 1, wherein the body also presents tertiary orifices disposed on a tertiary outline surrounding the axis of rotation and designed to emit tertiary air jets, each tertiary air jet being inclined relative to the axis of rotation in a tertiary direction presenting axial, radial, and circumferential components such that said tertiary air jets freely cross the region where the at least one sprayer edge is located.

3. A rotary sprayer according to claim 1, wherein the orifices disposed on each contour are associated in subgroups of orifices that are juxtaposed from one to the next, each of the subgroups being connected to one of the two independent compressed air feed sources via valves, respectively, and the valves being controllable independently of one another.

4. A rotary sprayer according to claim 1, wherein the secondary direction presents a zero circumferential component.

5. A rotary sprayer according to claim 1, wherein the primary and secondary channels are made by drilling through an outer jacket or are constituted by gaps formed between the outer jacket and an inner jacket, the jackets being disposed around the rotary drive member and a rear portion of the material sprayer member.

6. A rotary sprayer according to claim 1, wherein the components of the primary air jet are determined in such a manner that the primary air jets flow at a radial distance from the at least one sprayer edge lying in the range 0 to 25 mm.

7. A rotary sprayer according to claim 1, wherein the components of the secondary air jets are determined in such a manner that the secondary air jets strike the member at an axial distance from the at least one sprayer edge that lies in the range 0 to 10 mm.

8. A rotary sprayer according to claim 1, wherein the circle on which the primary and secondary orifices are disposed has a diameter lying in the range 58 mm to 80 mm, for the sprayer member having a diameter equal to 55 mm.

9. An installation for spraying a coating material, the installation being characterized in that it includes at least one rotary sprayer according to claim 1.

10. A rotary sprayer as claimed in claim 1, wherein the primary direction of each said primary air jet is different from the secondary direction of each said secondary air jet.

11. A rotary sprayer according to claim 1, wherein the primary and secondary channels are made by drilling through an outer jacket and are constituted by gaps formed between the outer jacket and an inner jacket, the jackets being disposed around the rotary drive member and a rear portion of the material sprayer member.

12. A rotary sprayer according to claim 1, wherein the components of the primary air jet are determined in such a manner that the primary air jets flow at a radial distance from the at least one sprayer edge that is equal to 1.5 mm.

13. A rotary sprayer according to claim 1, wherein the components of the secondary air jets are determined in such a manner that the secondary air jets strike the member at an axial distance from the at least one sprayer edge that is equal to 2.8 mm.

14. A rotary sprayer according to claim 1, wherein the circle on which the primary and secondary orifices are disposed has a diameter equal to 68 mm, for the sprayer member having a diameter equal to 55 mm.

15. A rotary sprayer according to claim 1, wherein the primary and secondary channels are connected respectively to a primary common chamber and to a secondary common chamber, said chambers being defined in the body and constituting two independent compressed air feed sources.

16. A rotary sprayer according to claim 1, wherein the primary orifices are arranged on the common circle in alternation with the secondary orifices.

17. A rotary sprayer according to claim 1, wherein the radial component of the secondary direction is oriented towards the axis of rotation.

18. A rotary sprayer according to claim 1, wherein the common circle has a diameter which is larger than a diameter of the at least one sprayer edge.

* * * * *